US006689026B2

(12) United States Patent
Almada

(10) Patent No.: US 6,689,026 B2
(45) Date of Patent: Feb. 10, 2004

(54) ABDOMINAL EXERCISE STATION

(75) Inventor: Stephen J. Almada, 401 W. Ontario St., Suite 203, Chicago, IL (US) 60610

(73) Assignee: Stephen J. Almada, Chicago, IL (US)

( * ) Notice: Subject to any disclaimer, the term of this patent is extended or adjusted under 35 U.S.C. 154(b) by 89 days.

(21) Appl. No.: 09/932,778

(22) Filed: Aug. 20, 2001

(65) Prior Publication Data

US 2003/0036467 A1 Feb. 20, 2003

(51) Int. Cl.[7] ..... A63B 26/00

(52) U.S. Cl. ..... 482/140; 482/148; 446/220; 273/58 R; 473/52

(58) Field of Search ..... 482/79, 95–96, 482/112, 145, 907, 140, 148; 446/220, 221–6; 473/52–53; 273/58 R

(56) References Cited

U.S. PATENT DOCUMENTS 495,863 A * 4/1893 Whitzel ..... 446/335
5,070,610 A * 12/1991 Leslie ..... 29/899
5,690,389 A * 11/1997 Ekman et al. ..... 297/452.41
6,056,622 A * 5/2000 Chung ..... 446/335
6,478,721 B1 * 11/2002 Hunter ..... 482/140

* cited by examiner

*Primary Examiner*—Nicholas D. Lucchesi
*Assistant Examiner*—L Amerson
(74) *Attorney, Agent, or Firm*—Matthew Pasulka

(57) ABSTRACT

An abdominal exercise device that allows the exerciser to do sit-up type exercises to stress the exerciser's abdominal muscles. The device has a frame assembly made of several members. A deformable seat for the exerciser is connected to frame assembly. The deformable seat is a fillable container. Footholds are positioned on the frame assembly to allow an exerciser to sit on the deformable seat and place the exerciser's feet in the footholds while performing an exercise. Additionally, there are handholds that an exerciser may hold so that an exerciser may stabilize himself while getting on and off the exercise device and during performance of exercise.

12 Claims, 4 Drawing Sheets

ABDOMINAL EXERCISE STATION

BACKGROUND OF THE INVENTION

1. Technical Field

This invention generally relates to exercise equipment. More specifically, this invention relates to exercise equipment for the abdominal muscles that allows the abdominal muscles to be more specifically isolated while not adding undo strain on the back.

2. Background Information

Throughout the years, many doctors, athletes and physical therapists have tried to create machines and exercises to develop and maintain the abdominal muscles. Traditionally, the best exercise for the abdomen is said to be the sit-up. However, we have since learned that the sit-up does not necessarily work the abdomen and that the situp may cause other injuries.

Over the years, doctors and therapists have learned that the traditional sit-up puts unnecessary strain on the back and actually works the hip flexor muscles. Many have tried to develop alternative sit-up like exercises to tone the abdominal muscles like the crunch, curl, rocky's, elevated and v-ups.

Others have tried to develop exercise equipment to minimize the problems associated with the sit-up. These abdominal exercise machines include the ABROLLER, the ABFLEX, the ABDOER and the ABDOMENIZER. These pieces of equipment are designed and sold for home use. Additionally, if these pieces of equipment are used improperly, the user may put unnecessary strain on his back and risk serious injury. Additionally, these machines are not able to work all of the upper abdominal muscles, the lower abdominal muscles, the obliques, and the lower back muscles.

While there have been many different types of abdominal exercises and exercising devices in the field, a number of such devices produce results which do not necessarily strengthen the abdominal muscles but strengthen the hip and thigh muscles which attach to the lumbar spine area and to the rear of the pelvis and hip bones. When such muscles contract not only does the rectus muscle of the abdomen work with little effort but the other muscles rotate the pelvis forward thus creating the occurrence of increased lower back pain which contributes to poor mechanical alignment and undesirable upright posture of the exerciser. Normally, in the performance of conventional sit-up exercises, the feet are projected horizontally or locked under a stationary object to obtain desired leverage. The stronger leg muscles substitute for the abdominal muscles which are not more positively strengthened by the sit-up type exercise. It is preferred that the legs be in a bent position during the sit-up exercise rather than projecting horizontally in locked position.

Recently, doctors, trainers and companies have recognized some of the shortcomings of the traditional exercises and exercise equipment. One of the responses is the exercise ball. The exercise ball is typically made of a resilient material that can be inflated into a deformable sphere. The inflated sphere can vary in size from about two feet in diameter to about five feet in diameter.

The exercise ball allows a person to do abdominal exercises while minimizing the strain on the back. Currently, the ball is often prescribed as physical therapy after back surgery because it is very effective at helping to strengthen the muscles around the midsection. Although the exercise ball alleviates some of the problems with back strain, it is not practical for the serious exerciser. One of the problems with the exercise ball is that it requires a lot of balance on the part of the exerciser because the ball is inherently unstable. Because of its instability, the exerciser focuses his energy on balancing himself atop the exercise ball rather than focusing on the exercise. As such, the exercise ball has been relegated to a physical therapy role and home use role.

The exercise ball has several risks associated with it. As mentioned above, the ball is inherently unstable. There are some risks associated with using the exercise ball because of its instability. Additionally, the ball is subject to catastrophic failure. The balls currently used sometimes rupture and immediately deflate. If someone is atop an exercise ball, whether an athlete or a post-operation patient, when a catastrophic failure occurs, typically the exerciser will crash to the floor at least shaken and hopefully uninjured. The sudden deflation of the exercise ball causes the exerciser to drop a distance equal to the diameter of the ball and without any resistance given by the ball could very easily injure his tailbone, lower back area, or neck.

A need therefore exists for an improved abdominal exercise device that overcomes the aforementioned problems.

SUMMARY OF THE INVENTION

The present invention overcomes the foregoing disadvantages of the prior art and provides an improved piece of abdominal exercise equipment.

Accordingly, it is an object of the present invention to provide a piece of exercise equipment that works the abdominal muscles.

It is another object of this invention to provide an exercise device that is suitable for physical therapy as well as gym use.

It is still another object of this invention to provide a multi-exercise piece of equipment.

Yet another object of the invention is to provide a piece of abdominal exercise equipment that alleviates strain on the lower back by supporting the exerciser but allows some give while the exercise is performed.

Still another object of the invention is to provide a piece of exercise equipment whereby the exerciser has a lower risk of catastrophic equipment failure.

These and other objects of the present invention are achieved by providing a resilient deformable seat or object attached to a frame assembly whereby the structure has handholds or footholds or both to help an exerciser stabilize himself while getting on and off the exercise device and while performing the exercise.

Another embodiment of the invention is an abdominal exercise device having a plurality of interconnected frame members. The frame members form the frame assembly. A deformable seat, preferably an exercise ball or an inflatable chair, is supported by the frame assembly in a predetermined position to the frame assembly. The frame assembly also has frame members that form footholds. The footholds are positioned at a variety of heights so that an exerciser sitting on the seat assembly may bend his legs to use the footholds. The exercise device may also have a frame member forming an arcuately moveable headrest. Handholds may also be attached to the frame assembly so that an exerciser may stabilize himself during exercise.

In another embodiment of the invention, an exerciser may use a stationary exercise device for doing sit-up type exercises to stress the exerciser's abdominal muscles. The exercise device has at least one fillable chamber formed from flexible resilient material adapted to contain a fluid medium for comfortably supporting the body of the exerciser. It also has a base that receives and supports the fillable chamber. The base is connected to footholds whereby an exerciser may sit on the fillable chamber and place his feet in the foothold while performing exercises.

In another embodiment of the invention, a catastrophic failure resistant ball is used. The catastrophic resistant ball has an outer shell or outer ball portion. The outer ball portion is made from a flexible puncture resistant material, preferably a high-strength rubber or plastic. The outer ball portion may be shaped into a variety of shapes including a chair or a sphere of a predetermined volume. Inside the outer ball portion is an inner ball portion. The inner ball portion may be made of the same material as the outer ball portion. The inner ball portion may be any three-dimensional shape as long as it fits almost entirely within the outer ball portion. The inner ball portion is fillable through an accessible closable opening or valve. With this design, even if the outer ball portion is punctured, a properly filled inner ball portion will act as a spring-like device, preventing the exerciser from crashing to the ground.

In yet another embodiment of the invention, an exercise ball made from flexible, rupture resistant material is shaped to form a sphere of a predetermined volume capacity when full. There is at least one inner ball portion made from semi-flexible material so that as the weight of the exerciser is placed on the ball at least two interior compartments or chambers are formed within the exercise ball. The inner chambers preferably do not communicate with each other; however, they may as long as the flow of a fluid between the interior compartments is retarded, thus preventing an exerciser from collapsing the ball entirely and contacting the ground when the outer ball portion fails.

Still another embodiment of the invention is an exercise ball having an outer shell made from flexible material. The outer shell may have a variety of shapes including a sphere that holds a predetermined volume capacity when full. The outer ball portion being at least partially filled with a fluid. There is also at least one inner ball portion made from semi-rigid material so that when weight is placed on the exercise ball and the outer ball portion is thereafter at least partially emptied, the weight on the exercise ball is supported by the inner ball portion for a short time, preventing instantaneous collapse of the exercise ball.

Additional object and advantages of the invention are set forth in the detailed description herein, or will be apparent to those of ordinary skill in the art. Also it should be appreciated that modifications and variations to the specifically illustrated and discussed embodiments and uses of this invention may be practiced without departing from the spirit and scope thereof, by virtue of present reference thereto. Such variations may include but are not limited to, substitution of equivalent parts, parts with equivalent functions, or multiple pieces so that the device has the same function for those shown or discussed.

For a fuller understanding of the nature and objects of the invention, reference should be made to the following detailed description taken in connection with the accompanying drawings, which illustrate, by way of example, the principles of the invention.

BRIEF DESCRIPTION OF THE DRAWINGS

The preferred embodiment of the invention, illustrative of the best mode in which the applicants have contemplated applying the principles, are set forth in the following description and shown in the drawings and are particularly and distinctly pointed out and set forth in the appended claims.

Similar numerals refer to similar parts throughout the drawings.

DESCRIPTION OF THE PREFERRED EMBODIMENT

The above detailed description of the present invention is given for explanatory purposes. It will be apparent to those skilled in the art that numerous changes and modifications can be made without departing from the scope of the invention. Accordingly, the whole of the forgoing description is to be construed in an illustrative and not a limitative sense. The scope of the present invention is to be limited only to the extent of the claims that follow.

Figure 1:
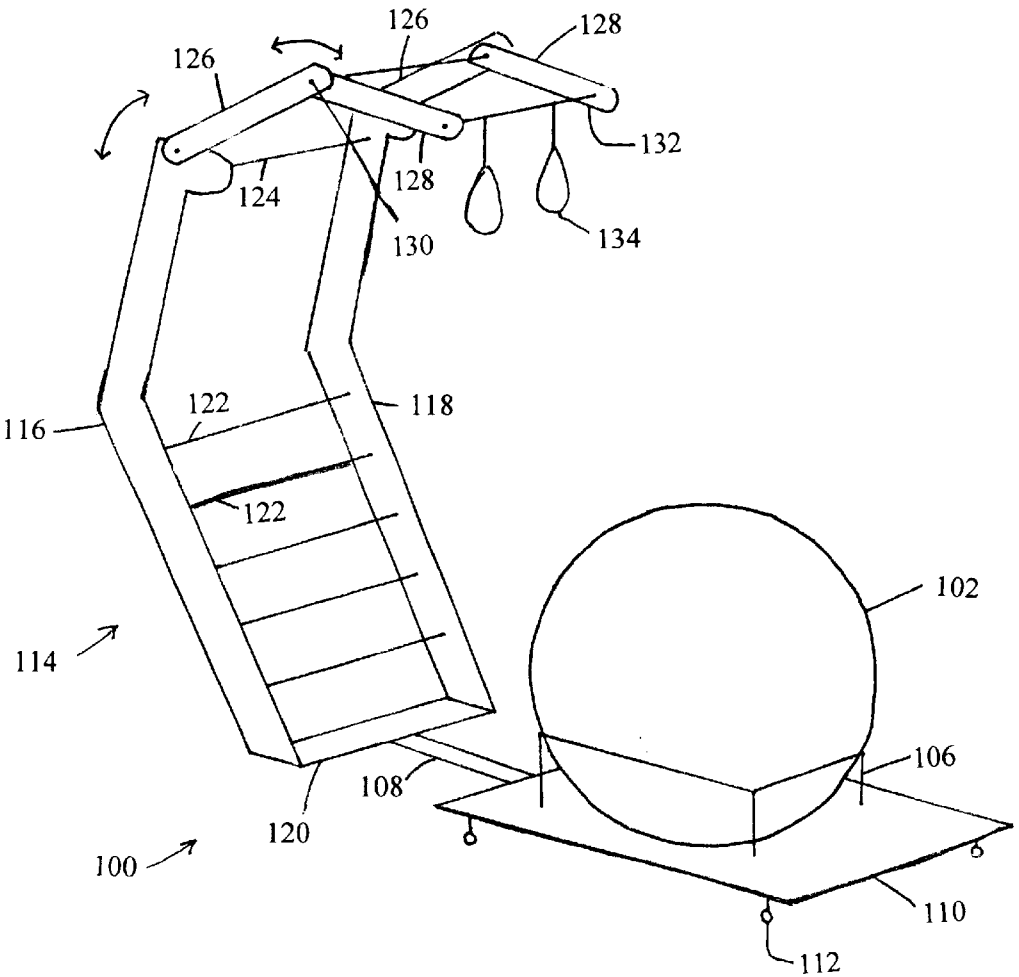
FIG. 1 is a perspective view of a preferred embodiment of the invention.

With reference to the drawings, specifically FIG. 1, the abdominal exercise device is indicated generally at 100. The abdominal exercise device 100 comprises a frame assembly shown generally at 104 that has a plurality of members. The members form a base 106 that supports the fillable chamber 102. The base 106 is designed to support the fillable chamber 102 without interfering with its operation. Preferably, if a sphere type fillable chamber 102 is used, the base 106 will be a circular type of collar securably mounted to the exercise device 100. Additional members comprising the frame assembly 104 may include a moveable base support 110 that is preferably mounted on wheels 112, coasters or the like.

The base support 110 is operably connected to holding members shown generally at 114 through rail 108. The rail 108 allows for the base support 110 to be moveably positioned closer to or farther from the holding members 114. The mechanism that allows the base support 110 to be moveably positioned on rail 108 can be any mechanism that is typically seen in gyms or performs the same function. The spring loaded bolt/hole method is sufficient to lock temporarily the base support 110 into a given position along the rail 108 for the duration of the exercise. The exerciser may adjust this position if he desires a more comfortable or efficacious position for the exercise.

The holding members 114 are comprised of a left vertical support 116 and a right vertical support 118. The left and right vertical supports 116 and 118 are connected to the rail 108 through holding member base 120. The holding member base 120 separates the left and right vertical supports 116 and 118. Additionally, the left and right vertical supports 116 and 118 are also separated by a plurality of footholds 122. The footholds 122 are spaced apart from each other so that an exerciser may place his feet between two adjacent footholds 122 so that his feet are held while the exerciser performs an exercise. The footholds may be padded to ease the strain on an exerciser's legs, feet or ankles. The upper portions of the holding members 114 may also be spaced by brace 124. Preferably, the holding members 116 and 118 are spaced wider than the width of a broad shouldered man.

Additional links 126 and 128 may be attached to the vertical supports 116 and 118. Preferably, if additional links 126 and 128 are attached, they are pivotably connected through bars 124 and 130 respectively. The links may be held in place by inserting pins to limit the rotation of the links 126 and 128. By the same token, the pins may be removed so that the bars may be rotated out of the way. The bars 124, 130 and 132 may be covered in padding so that an exerciser may comfortably use the bars as grips or headrests. Handholds 134 may be attached to the equipment to allow the exerciser to stabilize himself while getting on or off the device or during exercising.

Figure 2:
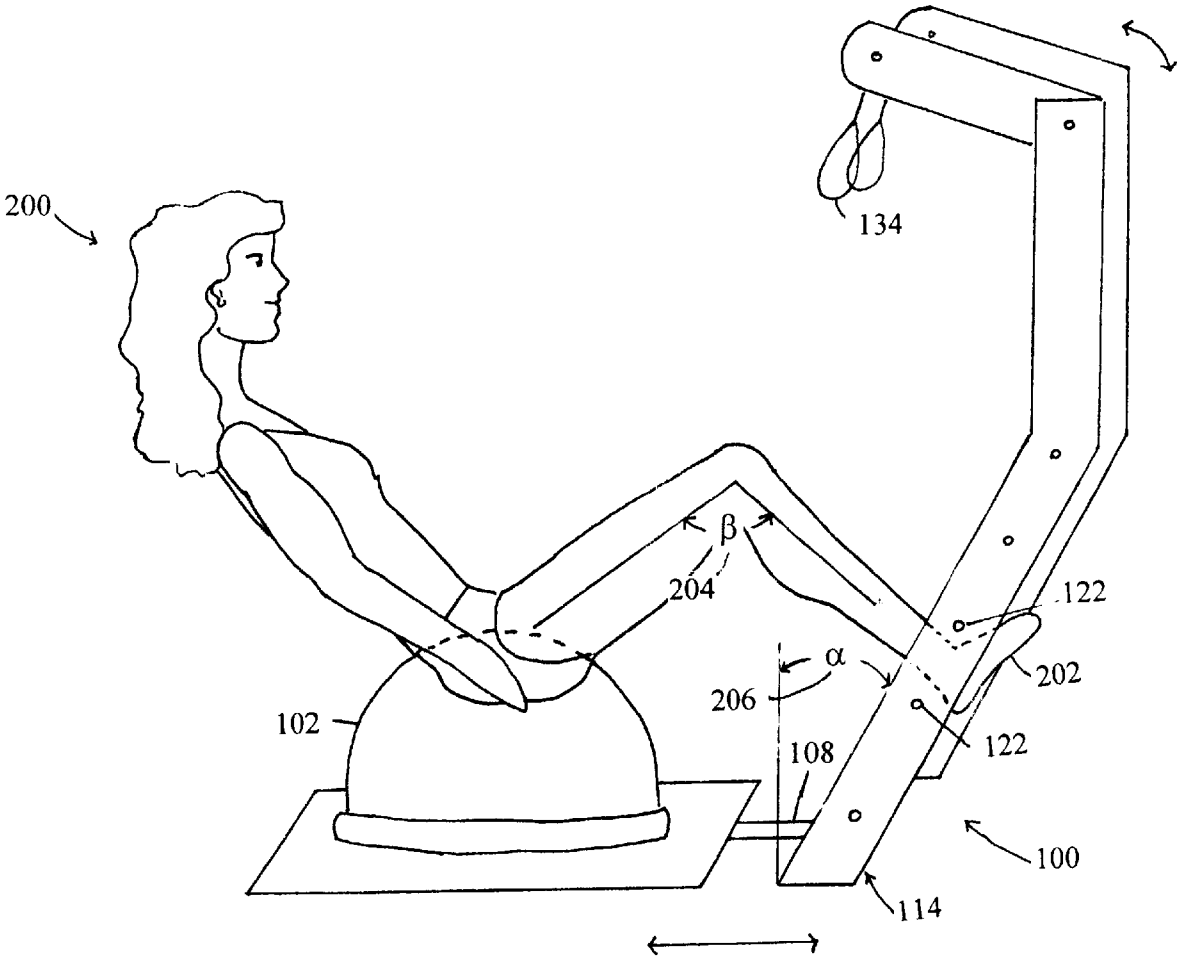
FIG. 2 is a perspective view of a preferred embodiment of the invention while being used by an exerciser.

Referring now to FIG. 2, exerciser 200 is sitting on the fillable chamber 102 with her feet 202 placed between footholds 122. By placing her feet between footholds 122 she can maintain her balance, maintain the angle β 204 between her thighs and lower legs, and apply stress to her abdominal muscles. Holding members 114 are positioned at angle α 206 to allow a variety of feet positions based on the exercises the exerciser wants to perform, the muscles that the exerciser wants to work, and the stress the exerciser wants to put on her muscles. Angle α 206 may range from 0 to 45 degrees. Preferably the angle is about 15–30 degrees. In another embodiment of the invention, the angle α may be varied.

The exerciser 200, when sitting on the fillable chamber 102, in this figure an exercise ball 102, deforms the exercise ball 102. As the exerciser performs exercises on the exercise ball 102, the fillable chamber 102 allows the buttocks and lumbar region to move slightly, thus allowing the abdominal muscles, rather than the hip flexors to perform the exercise. When the exerciser is finished with the exercise, exerciser 200 may grab handholds 134 with her hands and support and balance herself while she rests or removes her feet from the footholds 122. Additionally, the exerciser may reverse her position from that shown in the drawing so that her back is facing the footholds. In this position the headrest may be moved into position so that the exerciser may have support for her head. Additionally, the exerciser may use the handholds to stabilizer herself during exercises.

Referring now to fillable chamber 102, the preferred embodiment of the invention is an exercise ball. Other types of fillable chambers may be used with the proper adaptations to the exercise equipment. The use of other types of fillable chambers are within the scope of this invention. Types of fillable chambers include a single chamber exercise ball, a multi-chamber exercise ball, an inflatable seat or other similar devices. The fillable chamber 102 is designed to hold a fluid, whether a liquid such as water or a gas such as air, but may also use a deformable foam or rubber as well. The fillable chamber if it contains a compressible fluid should be less deformable than a fillable chamber designed to contain an incompressible fluid. The fillable chamber 102 is preferably not filled to the fillable chamber's capacity. If the fillable chamber 102 is filled to capacity, the fillable chamber 102 is more apt to rupture or have catastrophic failure, especially when weight is placed on fillable chamber 102.

Preferably, fillable chamber 102 is filled to approximately 60% to 80% of its peak capacity, but may be adjusted for the needs of the exerciser. The adjustment may be a manual addition or subtraction of fluid, or it may be automatic.

One of the major problems of the prior art is that the fillable chamber, particularly the exercise ball, is subject to catastrophic failure. If an exerciser is positioned on the exercise ball when the ball undergoes catastrophic failure, the exerciser is apt to crash to the ground injuring his coccyx. In order to avoid this, this invention also tries to minimize the distance that an exerciser would fall and cushion the fall as well as limiting the speed of the fall.

Figure 3A:
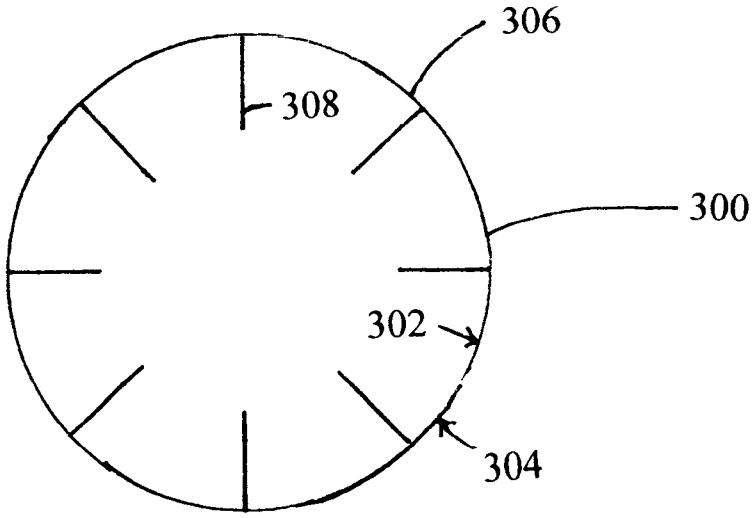
FIG. 3A is a sectional view of a fillable exercise device that is at least partially filled.

Referring now to FIG. 3A, a cross-sectional view of an exercise ball 300, the ball 300 has an inner surface 302 and outer surface 304. The exercise ball has an outer ball portion 306. The outer ball portion 306 is made from a flexible, resilient material. Preferably, the material is shaped into a sphere; however, any shape conducive to the principals of the invention may be used. Attached to the inner surface 302 of the exercise ball 300 is at least one inner ball portion 308. The inner ball portions 308 are made of a semi-rigid material, preferably rubber, and act as springs. The exercise ball 300 is fillable with a fluid, whether a gas or liquid or other deformable substance. When an exerciser places his weight on a filled ball, the exercise ball becomes a deformable vessel under pressure and the fluid supports the weight. A more detailed explanation of the deformation of flexible vessels and fluids under pressure is easily attainable from any fluids textbook.

Figure 3B:
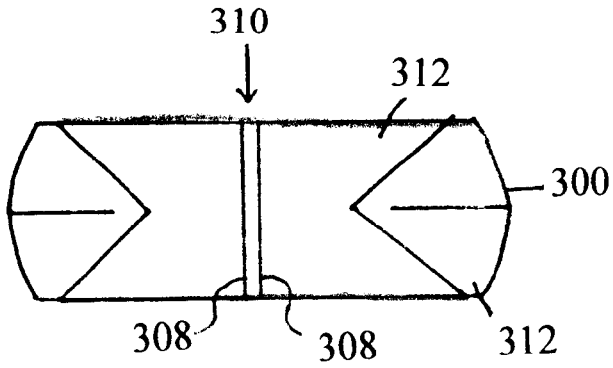
FIG. 3B is a sectional view of a fillable exercise device in operation.

Referring to FIG. 3B, the figure shows a catastrophically failed exercise ball deformed by weight 310. The weight 310 causes exercise ball 300 to collapse at least partially as the fluid flows out of the exercise ball. The inner ball portions 308 prevent complete collapse of the ball 300 and act as springs so that the weight is loaded on the inner ball portion. If the fluid evacuates quickly, the inner ball portions if made of a spring like material can function as springs to cushion and slow the fall. When the exercise ball is emptied of enough of its fill, the weight on the exercise ball is supported by the inner ball portion rather than the internal pressure of the fluid filled exercise ball. Alternatively, if the fluid inside the exercise ball evacuates slowly because of the internal structure of the exercise ball, the exerciser will not suddenly find himself on the ground when the ball ruptures.

Figure 4:
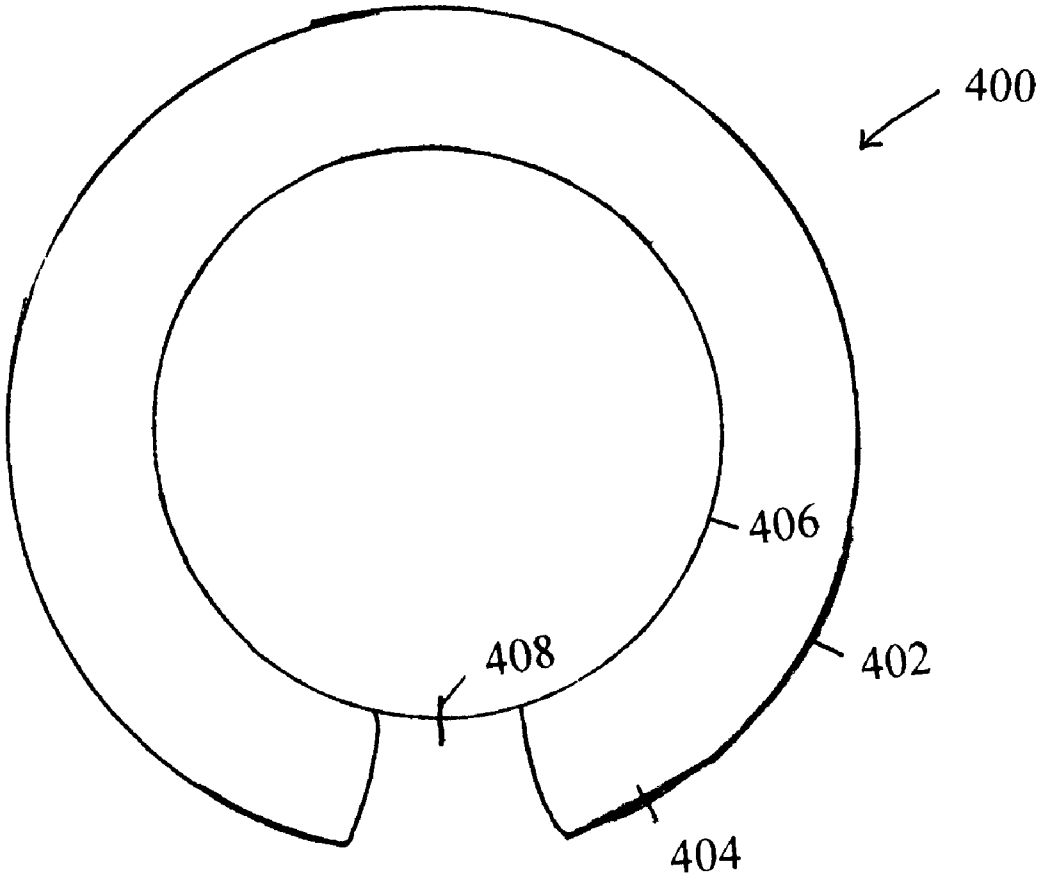
FIG. 4 is a sectional view of a fillable exercise device.

Referring now to FIG. 4, the figure shows an exercise ball 400 with a hollow fillable outer ball portion 402. The outer ball portion 402 is made from a flexible resilient material to form a sphere of a predetermined volume capacity when full of a fluid. The outer ball portion 402 has a closable opening or valve 404 that can be used to fill the outer ball portion 402. The exercise ball also has an inner ball portion 406 that is completely or almost entirely positioned within the outer ball portion 402. Valve 408 communicates with the exterior of the ball 400 allowing the inner ball portion 406 to be filled. Thus, there are two separate chambers, so that if one chamber is deflated, the other does not necessarily deflate. By only having one chamber deflate during a catastrophic failure the exerciser is typically protected from harm by the other filled chamber. Typically, the outer ball portion will be the chamber that catastrophically fails. If that is the case, the inner ball portion will prevent the exerciser from falling onto the floor and risking possible injury.

In another embodiment of the invention, a fillable device of FIGS. 3*a* and 3*b* has a similar structure, but a different operating mechanism. The inner ball portions 308 seal or matingly engage with the outer ball portion or mother inner ball portions so that a plurality of internal chambers 312 are formed. These chamber may communicate with each other, but preferably they do not. If the chambers do communicate with each other, they should retard the flow of fluid between the chambers so that in the event of a breach of the outer ball portion, the inner chambers are not instantly emptied of their contents. Thus, if an exerciser is using this fillable device, the exerciser will not hurt himself in the event of a catastrophic failure.

Further yet, it should be understood that the foregoing relates only to a preferred embodiments of the present invention, and that numerous changes and modifications may be made therein without departing from the spirit and scope of the invention as defined in the following claims.

What is claimed is:

1. A exercise ball comprising: a hollow fillable outer ball portion made from flexible material shaped to form a sphere of a predetermined volume capacity when full, said outer ball portion being at least partially filled with a fluid; at least one inner ball portion made from semi-flexible material so that as the weight of an exerciser is placed on the ball at least two partially separated interior compartments are formed so that flow of a fluid between the interior compartments is retarded.

2. A stationary exercise device for use by an exerciser doing sit-up type exercises to stress the exerciser's abdominal muscles, said device comprising: at least one fillable chamber formed from flexible resilient material adapted to contain a fluid medium for comfortably supporting the body of the exerciser; a base configured to receive said fillable chamber; and at least one foothold whereby an exerciser may sit on the fillable chamber and place his feet in the foothold while performing exercises.

3. A stationary exercise device according to claim 2 wherein the fillable chamber is an exercise ball.

4. A stationary exercise device according to claim 2 wherein the base is moveably connected to the foothold so that the exerciser may adjust the distance between the foothold and the fillable chamber.

5. A stationary exercise device according to claim 2 wherein there are a plurality of footholds positioned so that exercisers of various heights may utilize the machine.

6. A stationary exercise device according to claim 2 wherein there are a plurality of footholds positioned so that an exerciser may vary the difficulty of an exercise by varying the foothold that the exerciser uses.

7. An exercise device according to claim 2 wherein said exercise device further comprises a plurality of frame members interconnected to form a frame assembly connected to said base.

8. An exercise device according to claim 7 wherein the frame members form a foothold.

9. An exercise device according to claim 2 wherein the chamber is an exercise ball that does not immediately empty its contents in the event of a catastrophic failure.

10. An exercise device according to claim 2 wherein the chamber will prevent any weight positioned on the chamber from making immediate contact with the base if the deformable seat ruptures.

11. An exercise device according to claim 2 wherein said exercise device has an arcuately moveable headrest attached to the base by at least one fame member.

12. An exercise device according to claim 2 wherein said exercise device has at least one handhold device to stabilize himself during exercise, said handhold device is connected to the base by at least one of frame member.

* * * * *